United States Patent [19]

Goodnight et al.

[11] 4,105,395

[45] Aug. 8, 1978

[54] REGENERATIVE TILE STRUCTURE FOR FUEL BURNERS

[75] Inventors: Hershel E. Goodnight; Robert D. Reed; Alan D. Witwer, all of Tulsa, Okla.

[73] Assignee: John Zink Company, Tulsa, Okla.

[21] Appl. No.: 743,097

[22] Filed: Nov. 19, 1976

[51] Int. Cl.[2] ..... F23D 15/00

[52] U.S. Cl. ..... 431/351; 431/187; 239/416.5; 239/424; 239/425

[58] Field of Search ..... 431/116, 181–185, 431/351, 187, 188; 239/416.4, 416.5, 417.3, 424, 425; 427/376 C, 376 D

[56] References Cited

U.S. PATENT DOCUMENTS

| | | | |
|---|---|---|---|
| 2,857,961 | 10/1958 | Brown et al. | 431/116 |
| 3,006,782 | 10/1961 | Wheildon | 427/419 A |
| 3,007,512 | 11/1961 | Te Nuyl et al. | 431/183 |
| 3,368,605 | 2/1968 | Reed | 431/183 |
| 3,711,243 | 1/1973 | Zink et al. | 431/351 |

FOREIGN PATENT DOCUMENTS

| | | | |
|---|---|---|---|
| 559,548 | 7/1957 | Belgium | 431/116 |

*Primary Examiner*—Carroll B. Dority, Jr.
*Attorney, Agent, or Firm*—Head, Johnson & Chafin

[57] ABSTRACT

A regenerative tile structure for fluid fuel burners having a zirconium oxide coated metal flange shaped member providing a central orifice for producing a significant and very rapid increase in flame temperature by guided recirculation of hot flame gases.

5 Claims, 4 Drawing Figures

REGENERATIVE TILE STRUCTURE FOR FUEL BURNERS

BACKGROUND OF THE INVENTION

In the burning of all fluid fuels, there is concern for stability of burning and the speed with which the fuels burn. Rapid and stable burning of fuels of substantially any type has been a constantly sought goal since fuel burners were first invented. It is well known in the art of the burning of fluid fuels that the highest possible initial flame temperature is the key to both the speed of the burning of fuels and the stability with which the fuels burn. Means for production of highest initial flame temperature permit the burning of normally wasted calorific value fuels; and because of this, further conservation of heat energy is achieved.

The use of regenerative tile structures with burner apparatus has proven effective in the past as a means of obtaining the desired self-sustaining and rapid combustion of fuels. The basic operating principle behind these structures is to provide a sufficiently high flame temperature for effective fuel combustion. Such flame temperatures are maintained by combustion of the fuel within a refractory lined zone for heat retention and the recirculation of hot flame gases through the zone.

One such apparatus is disclosed in the U.S. Pat. No. 3,711,243, assigned to the John Zink Company. In this invention, atomized fuel is sprayed into a cylinder burning zone encased by an annular shaped ceramic tile. A second ceramic member having a downstream face disposed at right angles to the axis of the first ceramic tile is positioned adjacent the upstream end of the first tile and provides a central opening for fuel injection and the aspiration of air to the combustion zone. The downstream face of the second ceramic member serves to guide recirculating hot flame gases to the entering air stream, thus increasing the flame temperature.

Under certain combustion conditions, it becomes necessary to direct a flow of air immediately along the downstream face of the first annular tile to prevent the deposition of carbon. To accomplish this result, it is required that the second ceramic member be of slightly smaller outside diameter than the inner diameter of the first tile, thus forming an annular passageway for air.

Although the aforementioned apparatus is effective, it is apparent that a simplified design would lessen construction costs and improve the flame temperature increase to thereby enhance the value of the invention to the public.

Furthermore, the guided re-entry of hot gases into the air-fuel mixture at right angles dilutes the entering air supply, thereby retarding the initial fuel combustion reaction and lessening the desired effect of flame temperature increase due to recirculation on flame temperature.

SUMMARY OF THE INVENTION

The present invention contemplates a simplified regenerative tile structure for use in the combustion of fluid fuels which achieves significantly higher flame temperatures at a reduced construction cost in comparison to the apparatus revealed by the prior art. The novel invention comprises a cylindrical metal shell, an annular refractory sleeve, and a metal flange-shaped member providing a central orifice for the introduction of fuel and air to the interior of the refractory sleeve.

The annular refractory sleeve is mounted in a downstream portion of the metal shell to form a combustion zone. The downstream end facing of the refractory sleeve is preferably projected beyond the end of the shell and arcuately lipped for protection of the shell edge from high temperatures. A metal flange-shaped member, coated with zirconium oxide, located in the shell abutting the upstream face of the annular refractory sleeve, provides a centrally located orifice. The flange edges forming the orifice are arcuate and project downstream for maximum air delivery therethrough. By virtue of the arcuate projection, recirculating hot flame gases are diverted in a downstream direction rather than directly into the air flow as in the prior art.

For those fuels prone to deposit carbon on the interior upstream surfaces of the refractory sleeve, apertures may be bored in the flange-shaped member near the inner surface of the refractory for the passage of aspirated air therethrough.

DESCRIPTION OF THE PREFERRED EMBODIMENTS

Figure 1:
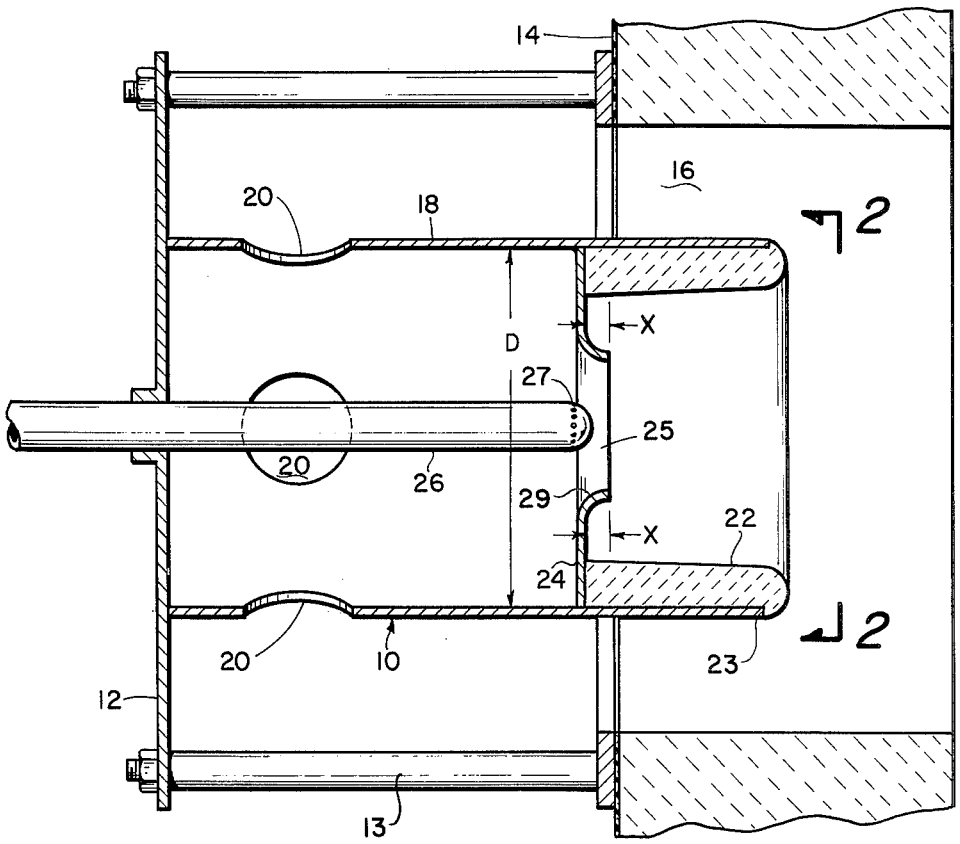
FIG. 1 is a sectional elevational view of a regenerative tile structure embodying the invention and installed in a furnace.
Figure 2:
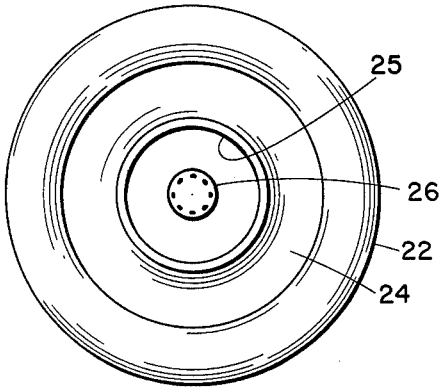
FIG. 2 is a view taken on line 2—2 of FIG. 1.

Referring to the drawings in detail and to FIG. 1 in particular, the numeral 10 generally indicates a regenerative tile structure suitable for burning any fluid fuel. The tile structure 10 is attached to end plate 12 in any suitable manner (not shown), which in turn is secured to a wall 14 of a furnace (not shown) in any well-known manner, such as by a plurality of spacer bolts 13, to position the tile structure in substantial alignment with an opening 16 in the furnace wall.

The tile structure 10 comprises a substantially cylindrical metal shell 18 having a plurality of circumferential ports 20 in the upstream portion thereof for the passage of air from the exterior thereof to the interior thereof. An annular refractory sleeve 22, preferably of a length less than the length of the shell 18, is mounted in a downstream portion of shell 18 and may be secured to the inner periphery of the shell in any suitable manner. The downstream end of refractory sleeve 22 projects beyond the downstream end of shell 18 and is preferably arcuate in cross sectional configuration, with a sufficient outwardly extended circumferential lip forming an annular shoulder to cover the end of the shell. The lip extension 23 provides protection for the end of the shell from high temperatures. A metal flange shaped member 24 is secured in shell 18, preferably in abuttment with the upstream end of refractory sleeve 22 and provides a centrally located discharge orifice 25 for the tile structure 10. A suitable nozzle 26 extends through the plate 12 and into the interior of shell 18 and is provided with a plurality of jets or openings 27 in the proximity of the discharge orifice 25 for spraying or discharging fuel into the interior of the zone formed by the refractory sleeve. The jets preferably provide a substantially conical spray pattern for the fuel. The spray of fuel from element 26 and air entering the tile structure through the circumferential ports are discharged through the orifice 25.

The metal immediately surrounding the orifice 25 is arcuately protruded downstream as shown at 29, thus forming a smooth, contoured passageway for air aspirated into the zone formed by the refractory sleeve. Flange shaped member 24 is preferably coated with zirconium oxide, for preservation of the metal in the presence of high temperatures. The depth, X, of the projection of the flange in the downstream direction should be no further than that depth which is beneficial to increase flame temperature. A preferred projection depth has been discovered to be approximately 10 percent of the flange face diameter, D, less the thickness of the flange face.

As previously mentioned, hot recirculating flame gases in the prior art merge forcibly with the induced air flow through the central orifice at right angles, retarding the initial combustion reaction by diluting the oxygen supply. It is observed, however, that the projection of the flange member 24 in a downstream direction in the present invention diverts the recirculating gases substantially downstream, thus delaying the combustion retarding mixture of air and relatively inert recirculating gas which occurs in the prior design. The configuration of the flange member orifice also results in a low pressure area created by the fuel flow which is concentrated in the space immediately adjacent to the orifice much more so than exists in the prior art, thus minimizing retardation of the air-fuel reaction.

Figure 4:
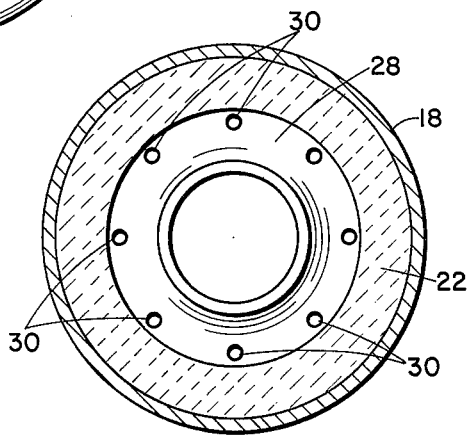
FIG. 4 is a view taken on line 4-4 of FIG. 3.
Figure 3:
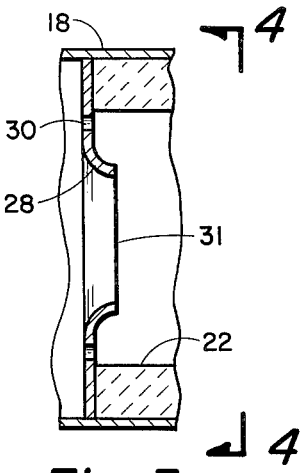
FIG. 3 is a fragmented sectional elevational view of a modified tile structure embodying the invention.

With certain fuels, it becomes necessary to direct air along the upstream inner surface of the refractory sleeve to prevent deposition of carbon. In the modification depicted in FIGS. 3 and 4, a flange member 28 is shown which has a plurality of circumferentially spaced apertures 30 around the center orifice 31 and spaced slightly inwardly from the inner periphery of the refractory sleeve 22. Air is drawn through these apertures 30 by aspiration in addition to the air entering the combustion zone via the central orifice 31. It is obvious that the simplified construction of the disclosed invention will result in considerable economies over the prior art while increasing the flame temperature, thereby improving the efficiency of the apparatus.

Whereas the present invention has been described in particular relation to the drawings attached hereto, it should be understood that other and further modifications, apart from those shown or suggested herein may be made within the spirit and scope of this invention.

What is claimed and desired to be secured by Letters Patent is:

1. A regenerative tile structure for a fluid fuel burner, which comprises:

a substantially cylindrical shell;

an annular shaped refractory sleeve, secured to the inner periphery of the cylindrical shell, and axially disposed in a downstream portion thereof;

a flange-shaped member, secured to the inner periphery of the shell in abuttment with the upstream end of the annular refractory sleeve, and having a coaxially located orifice, the edge of the member forming said orifice projecting in a downstream direction, and having a plurality of circumferentially spaced apertures around the orifice spaced slightly inwardly from the inner periphery of the annular refractory sleeve; and means for admitting combustion air to the shell upstream from the flange shaped member.

2. A regenerative tile structure for a fluid fuel burner, as recited in claim 1, wherein the annular refractory sleeve includes an outwardly extending circumferential shoulder adjacent the downstream end of the cylindrical shell.

3. A regenerative tile structure for a fluid fuel burner, as recited in claim 2, wherein the outer end of the refractory sleeve is of arcuate cross-sectional configuration.

4. A regenerative tile structure for a fluid fuel burner, as recited in claim 3, wherein the shell and the flange shaped member are constructed of metal and the flange shaped member is coated with zirconium oxide.

5. A regenerative tile structure for a fluid fuel burner, as recited in claim 3, wherein the shell is provided with a plurality of circumferentially spaced ports providing said means for admitting combustion air to the shell.

* * * * *